United States Patent [19]

Goldschild

[11] Patent Number: 4,678,035

[45] Date of Patent: Jul. 7, 1987

[54] METHODS AND APPARATUS FOR SUBSURFACE TESTING OF WELL BORE FLUIDS

[75] Inventor: Pierre Goldschild, Vulaines-sur-Seine, France

[73] Assignee: Schlumberger Technology Corporation, Houston, Tex.

[21] Appl. No.: 813,792

[22] Filed: Dec. 27, 1985

Related U.S. Application Data

[63] Continuation of Ser. No. 630,033, Jul. 12, 1984, abandoned.

[30] Foreign Application Priority Data

Jul. 12, 1983 [FR] France ..... 83 11629

[51] Int. Cl.[4] ..... E21B 34/14; E21B 43/12; E21B 47/06

[52] U.S. Cl. ..... 166/250; 166/240; 166/242; 166/332; 166/373; 166/386

[58] Field of Search ..... 166/250, 373, 385, 386, 166/142, 148, 188, 332, 72, 324, 331, 240, 242

[56] References Cited

U.S. PATENT DOCUMENTS

| | | | |
|---|---|---|---|
| Re. 31,313 | 7/1983 | Fredd et al. | 166/250 |
| 3,434,535 | 3/1969 | Page | 166/72 |
| 3,675,716 | 7/1972 | Kanady | 166/332 |
| 4,274,486 | 6/1981 | Fredd | 166/250 |
| 4,453,599 | 6/1984 | Fredd | 166/374 |
| 4,487,261 | 12/1984 | Gazda | 166/264 |

*Primary Examiner*—James A. Leppink
*Assistant Examiner*—Huang C. Dang

[57] ABSTRACT

In the representative embodiments of the new and improved methods and apparatus disclosed herein, a full-bore valve is cooperatively arranged to be tandemly coupled in a typical production string including a string of production pipe that is coupled to a packer isolating a lower well bore interval. A wireline measuring tool is lowered into the production string to land the tool in a measuring station defined therein above the valve. An anchor on the tool is extended to secure the testing tool in the measuring station. A mechanism is also provided on the testing tool for releasably engaging the actuator for the full-opening valve to open and close the valve by successive upward and downward movements of the tool suspension cable. A fluid-testing device is arranged on the testing tool for making successive measurements of one of more characteristics of the connate fluids in the well bore as the valve is successively opened and closed by the upward and downward movements of the cable. An anchor-retracting mechanism is also provided for selectively releasing the anchor only after a predetermined number of successive upward and downward movements of the cable.

17 Claims, 10 Drawing Figures

METHODS AND APPARATUS FOR SUBSURFACE TESTING OF WELL BORE FLUIDS

This is a continuation of U.S. application Ser. No. 630,033 filed July 12, 1984 now abandoned.

BACKGROUND OF THE INVENTION

This invention relates to new and improved methods and apparatus for performing static and dynamic tests of well bore fluids in a well bore. More particularly, this invention relates to new and improved methods and wireline apparatus adapted for successively measuring one or more properties or conditions of the connate fluids in an isolated interval of a production well while the well is under both static and dynamic flow conditions.

BACKGROUND ART

It is, of course, common practice to periodically test a completed well that is producing oil or gas by making a series of subsurface measurements of one or more characteristics of the connate fluids in an isolated interval of the well bore. As a minimum, these tests include measuring such characteristics as the pressure and temperature of these connate fluids. Additional measurements may also be made of such other characteristics as the electrical conductivity, density or other fluid properties of the connate fluids. Typically these tests are carried out by successively making one series of so-called dynamic measurements while the well is producing and another series of so-called static measurements while the well is shut-in.

Where it is possible to avoid the expense of conducting such tests by means of drillstem testing operations, various types of cable-supported testing tools are commonly used to make these measurements. To provide for these tools, the production string in most wells usually includes a full-opening tubular seating device such as a landing nipple or locking mandrel which is appropriately located in the production string to serve as a measuring station for supporting a testing tool while it measures these characteristics. The fluid communication between the production string and the isolated well bore interval is usually controlled by selectively operating a suitable control valve that either has been permanently arranged in the production string or else is temporarily positioned in the seating device before commencing the tests.

To use these so-called "wireline testing tools" the tool is coupled to a cable which is spooled in the usual fashion on a powered winch situated adjacent to the wellhead equipment. As is typical, the suspension cable is cooperatively directed from the winch into the wellhead equipment by means of an upper pulley or sheave supported above the well and a lower sheave mounted between the wellhead equipment and the winch. The tool is lowered through the production string to a desired depth in the well bore where the tool is operated as necessary to obtain the desired measurements. With some types of testing tools, the supporting cable includes electrical conductors so that these measurements can be monitored and recorded at the surface during the testing operation. Alternatively, with other types of tools, a so-called "slick line" having no electrical conductors is used to support the tool; and the measurements are recorded by means of a recorder mounted on the testing tool.

Although some wireline testing tools such as the one seen in U.S. Pat. No. 4,083,401 are electrically powered, it is generally preferred to use simpler mechanically operated testers which are positioned in a production well and then controlled by selectively raising and lowering the tool-suspension cable from the surface. Some of these mechanically operated testing tools are shown in U.S. Pat. No. Re. 31,313, U.S. Pat. No. 3,965,978, U.S. Pat. No. 4,134,452, U.S. Pat. No. 4,159,643 and U.S. Pat. No. 4,266,614.

In general, two basic problems must be considered when designing these cable-operated wireline testers. First of all, once a tool is positioned in its associated landing device, the tool must be anchored with sufficient restraining force to be assured that the testing tool will remain seated in the landing device when the supporting cable is pulled to operate the tool. Nevertheless, this restraining force can not be so great that the supporting cable might break under excessive tension when the testing tool is unseated following a test. It should be realized that since excessive tension will ordinarily cause a suspension cable to part at or near the surface, the experienced operator will make every effort to avoid the difficult fishing operation of removing a tangled skein of cable piled in the tubing string on top of the tool. Secondly, cable-operated wireline testers are commonly subjected to extreme pressure differentials as the control valve is opened and closed during the testing operation. As a result, these wireline testers should be designed so that extreme pressure differentials will not unduly affect the operation of the tester or hinder its retrieval following a testing operation.

OBJECTS OF THE INVENTION

Accordingly, it is an object of the present invention to provide new and improved methods and apparatus for selectively controlling from the surface the flow of connate fluids from an isolated well bore interval and successively measuring one or more characteristics of these connate fluids while the well is under static and dynamic flow conditions.

It is a further object of the present invention to provide new and improved wireline fluid-testing apparatus that is cooperatively arranged to be securely anchored in a production well and then selectively operated by successive movements of the supporting cable from the surface and thereafter released in response to a predetermined number of these cable movements.

SUMMARY OF THE INVENTION

These and other objects of the present invention are attained by providing new and improved fluid-testing apparatus including a full-bore valve body adapted to be coupled in a production string comprising a string of production tubing that is coupled to a packer isolating a lower interval of a well bore. The apparatus also includes full-opening valve means arranged in the lower portion of the axial bore of the valve body and adapted for controlling fluid communication between the isolated well bore interval and parallel fluid passages defined by the upper portion of the axial bore and an external passage between the intermediate and upper portions of the axial bore. The fluid-testing apparatus of the invention further comprises a cable-supported tester adapted to be lowered on a suspension cable through the production string and includes selectively-releasable anchoring means for releasably securing the tester at a measuring station arranged in the upper bore portion of the valve body. The tester further includes valve actuating means operable upon reciprocation of the suspension cable for selectively opening and closing the full-opening valve means whereby measuring means on the tester may successively measure at least one characteristic of the connate fluids in the isolated well bore interval under dynamic and static fluid conditions. The tester also includes means operable in response to multiple successive reciprocations of the cable for subsequently releasing the anchoring means from the valve body so that the tester can thereafter be retrieved from the production string without subjecting the suspension cable to excessive tension.

BRIEF DESCRIPTION OF THE DRAWINGS

The novel features of the present invention are set forth with particularity in the appended claims. The invention, together with further objects and advantages thereof, may best be understood by way of illustration of the following description of exemplary apparatus and methods employing the principles of the present invention as illustrated in the accompanying drawings, in which:

DESCRIPTION OF A PREFERRED EMBODIMENT

Figure 1:
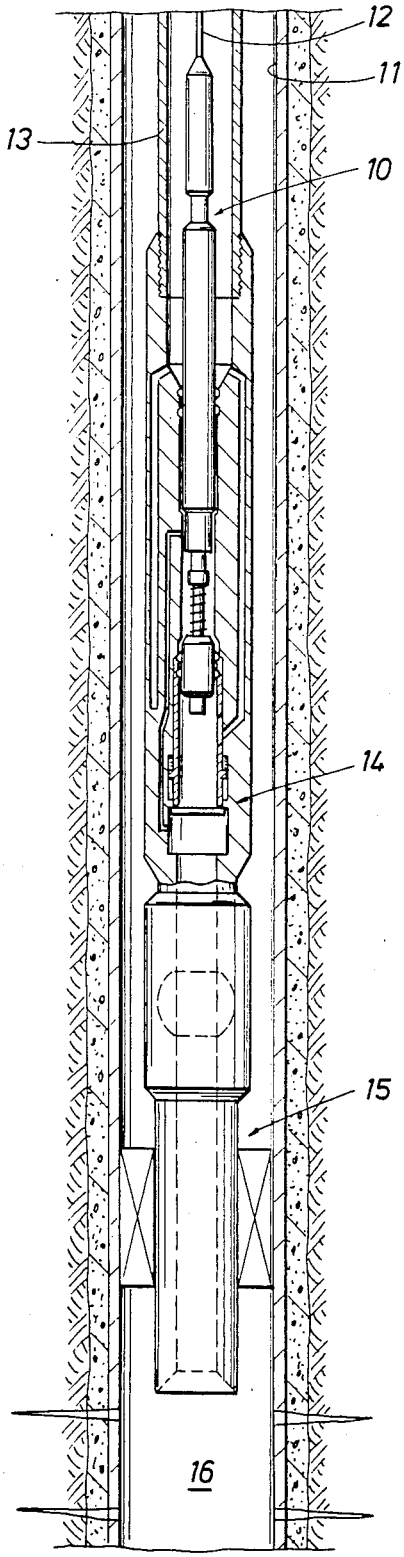
FIG. 1 shows the sub-surface portion of a production well including a string of production pipe and a typical packer which are tandemly coupled to full-bore valve means arranged in accordance with the principles of the present invention.

Turning now to FIG. 1, a new and improved wireline testing tool 10 of the present invention is shown in a cased production well 11 after the tool has been lowered by means of a suspension cable 12 through a typical production string including a string of production tubing 13 and then seated at a measuring station provided in full-bore valve means 14 of the invention which are tandemly coupled between the lower end of the tubing string and a typical production packer such as schematically shown at 15. It will be recognized, of course, that the tubing string 13, the valve means 14 and the packer 15 were previously coupled together and positioned in the well bore 11 and the packer was then set to isolate a particular perforated interval 16 of the well bore to be tested by practicing the present invention. As will be subsequently explained by reference to FIGS. 5–8, to practice the methods of the present invention the tool suspension cable 12 is successively reciprocated from the surface as required for the new and improved testing tool 10 to selectively operate the valve means 14 for controlling fluid communication between the tubing string 13 and the isolated well bore interval 16 while successive measurements are made of one or more characteristics of the connate fluids under both static and dynamic fluid conditions in the isolated interval.

Figure 2:
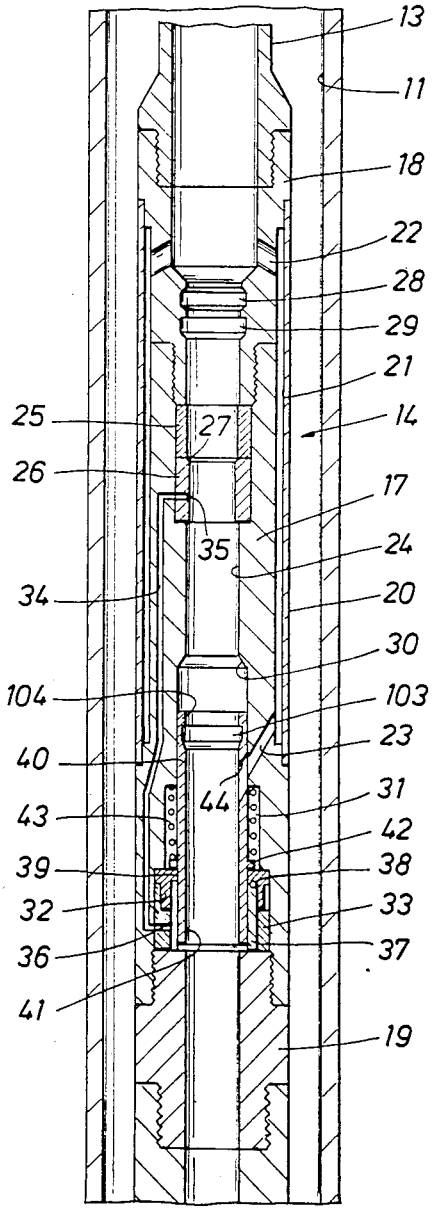
FIG. 2 is an enlarged, cross-sectioned elevational view of the new and improved valve means seen in FIG. 1.

Turning now to FIG. 2, an enlarged cross-sectioned elevational view is shown of a preferred embodiment of the full-opening valve means 14 arranged in accordance with the principles of the invention to be selectively controlled as the wireline testing tool 10 is operated. As depicted, the valve means 14 include an elongated tubular body 17 having upper and lower enlarged end pieces 18 and 19 respectively arranged with typical female and male threaded connections for tandemly coupling the valve body in the tubing string 13 at a convenient location above the packer 15.

In a preferred manner of arranging the valve means 14 to provide parallel internal and external fluid passages, the intermediate portion of the elongated tubular body 17 is reduced externally and a larger tubular member 20 cooperatively mounted around this reduced body portion for defining an enclosed annular space 21 between the upper and lower end pieces 18 and 19. The full-opening valve means 14 further include a plurality of upper and lower lateral ports, as at 22 and 23, suitably arranged in the reduced portion of the body 17 for freely communicating the upper and lower portions of the central axial bore 24 of the body with the upper and lower ends of the annular space 21. For reasons that will be subsequently explained, the inner and outer tubular members 17 and 20 are preferably arranged so that the transverse cross-sectional areas of the internal and external passages which are respectively provided by the axial bore 24 and the annular space 21 are substantially equal.

To facilitate the fabrication and assembly of the valve means 14, the intermediate portion of the axial bore 24 through the tubular body 17 is suitably enlarged so as to complementally receive annular inserts or members 25 and 26. As shown, the internal bores of these annular members 25 and 26 are preferably formed and sized so that the upper end of the lower member defines an upwardly-facing bevelled shoulder 27 in the axial bore 24 of the elongated body 17. Although a third annular insert with internal grooves could be appropriately arranged within the axial bore 24 of the body 17 above the inserts 25 and 26, in the illustrated embodiment of the valve means 14 the upper end piece 18 is instead cooperatively arranged to provide closely spaced upper and lower circumferential grooves 28 and 29 in its internal bore. As will subsequently be explained by reference to FIG. 3B, the upper and lower circumferential grooves 28 and 29 are cooperatively arranged to provide suitable anchor recesses in the upper portion of the axial bore 24. In the preferred manner of providing these anchor recesses, the circumferential groove 28 is symmetrically formed with diverging upper and lower surfaces that are respectively inclined upwardly and downwardly toward the internal bore of the upper end piece 18. Conversely, the lower groove 29 in the upper end piece 18 is asymmetrically formed so that its upper surface defines a downwardly facing annular shoulder. The lower surface of the groove 29 is inclined downwardly toward the internal bore of the end member 18.

The intermediate portion of the central bore 24 of the elongated body 17 is moderately enlarged to define a downwardly facing inclined or bevelled shoulder, as at 30, in the central bore. The lower portion of the central bore 24 is also substantially enlarged to provide an elongated annular space 31 in the central bore just above the lower end piece 19. Upper and lower annular members 32 and 33 are disposed in the lower portion of the annular space 31 immediately above the lower end piece 19.

For reasons which will subsequently be explained, a longitudinal passage 34 is also arranged in the elongated body 17 and communicated with the upper and lower ends of the axial bore 24 through the valve body by means of upper and lower lateral ports 35 and 36 respectively situated in the annular members 26 and 33.

The full-opening valve means 14 further include a disk member 37 which, as shown generally at 38, is conventionally arranged with a pivot support on one edge of the disk that is journalled by way of a transverse shaft to a matching pivot support on one wall of the annular member 32. In this manner the disk 37 can freely pivot between a horizontal passage-closing position where it is firmly seated against a downwardly facing annular valve seat defined by the lower face of an inwardly-directed shoulder 39 around the axial bore of the annular member 32 and the illustrated vertical passage-opening position where the disk is hanging below its pivot 38 adjacent to the internal wall of the annular member 32. As is common, the valve means 14 also include biasing means such as a typically arranged spring (too small to be seen in the drawings) for normally urging the disk 37 upwardly toward its passage-closing position against the valve seat 39.

In the preferred manner of arranging suitable actuating means for the full-opening valve means 14, an elongated tubular member 40 having an axial bore 41 of the same diameter as the axial bore 24 is cooperatively arranged within the enlarged annular space 31 and adapted to move longitudinally within the tubular body 17 between spaced upper and lower positions. In the illustrated embodiment of the full-opening valve means 14, the upper position of the actuator member 40 is established by the engagement of its upper end with the downwardly facing annular shoulder 30 in the central bore 24 of the body 17. The lower position of the actuator member 40 is defined by the engagement of an external shoulder 42 on the actuator member with the upper face of the annular valve seat member 32. Biasing means, such as a coil spring 43 between the upper face of the annular space 31 and the shoulder 42, are cooperatively arranged for normally urging the tubular member 40 downwardly in relation to the valve body 17. To assure that the actuator 40 will not unduly affect the flow of connate fluids into the external annular passage 21, a corresponding number of elongated ports, as at 44, are suitably arranged in the upper portion of the actuator. Thus, there is always unrestricted communication between the axial bore 24 of the elongated body 17 and each of the lower lateral ports, as at 23, in the body.

It will be recognized, therefore, that this arrangement of the new and improved valve means 14 of the invention does not preclude or limit the use of those wireline tools which must be lowered through the tubing string 13 and the valve means in order to perform various workover or completion operations in the well bore interval 16 below the packer 15. Moreover, by arranging the actuator member 40 to move freely within the annular valve seat member 32 as well as to move independently of the disk 37, the disk does not have to be connected to any moving element of the full-opening valve means 14. Those skilled in the art will, therefore, appreciate that this unique arrangement of the valve means 14 of the present invention also avoids various operating problems commonly encountered with those prior-art valve means having a central actuator coxially arranged within an annular valve member and connected thereto by some connecting means that enable the actuator to move in conjunction with the valve member as well as to move independently of the valve member.

Figure 3A:
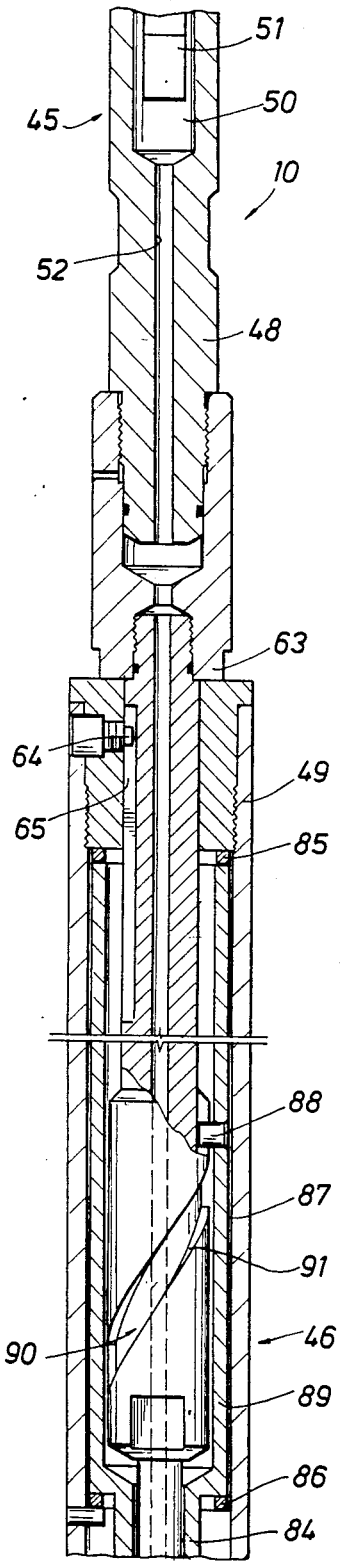
FIGS. 3A–3C are successive elevational views, partially in cross-section, of a preferred embodiment of a new and improved wireline testing tool incorporating the principles of the present invention.
Figure 3B:
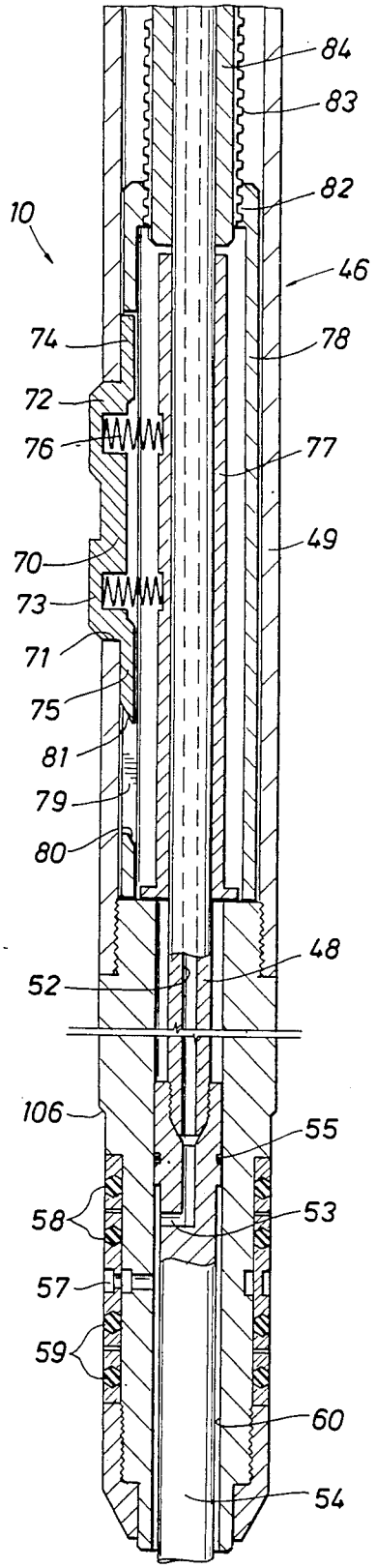
Figure 3C:
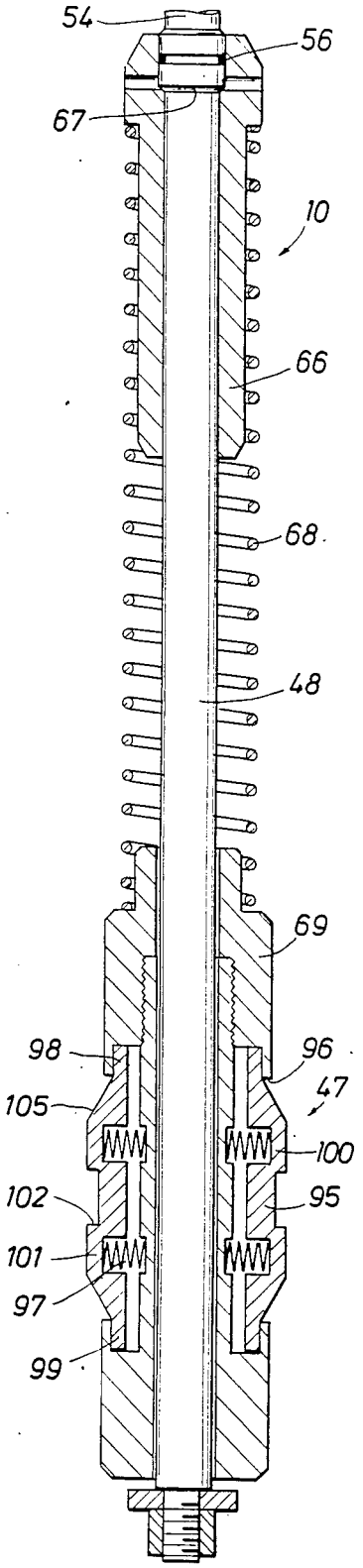

Turning now to FIGS. 3A–3C, successive, partially cross-sectioned, elevational views are shown of a preferred embodiment of the new and improved wireline testing tool 10 of the present invention as it will appear before it is coupled to the suspension cable 12 and lowered into a well bore to be seated in the full-opening valve means 14 as previously described by reference to FIG. 2.

In general, the new and improved testing tool 10 of the present invention includes fluid measuring means 45 carried by the upper and intermediate portions of the tool (as seen in FIGS. 3A and 3B), selectively-releasable tool anchoring means 46 mounted on the upper and intermediate portions of the tool, and valve actuating means 47 cooperatively arranged on the lower portion of the tool (as seen in FIG. 3C) for selectively controlling the full-opening valve means 14 during the practice of the methods of the invention. From the successive views of the fluid testing tool 10 in FIGS. 3A–3C, it will be seen that the tool includes an elongated mandrel 48 that is coaxially arranged within an elongated tubular housing 49. Those skilled in the art will, of course, appreciate that to simplify the fabrication, assembly and maintenance of the tool 10, the mandrel 48 and the housing 49 are each necessarily comprised of various interconnected sub-assemblies or individual components. However, to facilitate the following description of FIGS. 3A–3C, the various interconnected parts of the mandrel and the outer housing are simply designated by their respective reference numerals 48 and 49.

As seen in FIG. 3A, the fluid measuring means 45 of the tool 10 include an enclosed chamber 50 in the upper end of the mandrel 48 cooperatively arranged for receiving one or more measuring transducers and related electronic circuitry such as typical pressure-responsive sensor means 51 for transmitting representative output signals to the surface by the conductors in the cable 12 for being monitored and recorded by means of typical surface instrumentation (not shown in the drawings). It is, of course, considered within the scope of the present invention to arrange the mandrel 48 to instead carry a self-contained recorder when it is preferred to utilize a slick line or other suspension cable not having conductors for supporting the tool 10.

To communicate the sensor means 51 with the connate fluids in a well bore, the fluid measuring means 45 further include passage means such as an elongated axial passage 52 that is appropriately arranged in the mandrel 48 for communicating the enclosed chamber 50 (FIG. 3A) to a lateral port 53 (FIG. 3B) provided in a reduced-diameter intermediate portion 54 of the mandrel. As seen in FIGS. 3B and 3C, this port 53 is located between spaced sealing means such as provided by a pair of O-rings 55 and 56 respectively mounted on full-diameter mandrel portions above and below the lateral port. The passage means further include a lateral port 57 in the housing 49 which is disposed between spaced sealing members 58 and 59 arranged to be sealingly received within the annular member 26 above and below the lateral port 35. It will also be noted from FIG. 3C that in the lower operating position of the mandrel 48, the lower O-ring 56 is disposed a short distance below the lower end of the housing 49 so that fluids previously trapped in the chamber 50 and the passage 52 can be discharged from the tool 10 by way of the port 53 and the annular clearance space defined in the axial bore 60 of the housing around the reduced mandrel portion 54.

From FIG. 3A it will be seen that the lower operating position of the mandrel 48 is determined by the engagement of a downwardly facing mandrel shoulder 63 with the upper end of the housing 49. As also shown in FIG. 3A, a lateral key or inwardly projecting guide pin 64 is secured to the upper end of the housing 49 and slidably received within an elongated longitudinal groove 65 in the adjacent surface of the upper portion of the mandrel 48. In addition to securing the mandrel 53 against rotation with respect to the housing 49, it will also be seen that the guide pin 64 and the longitudinal groove 65 mutually cooperate to define the upper operating position of the mandrel when the lower end of the groove contacts the guide pin. In the upper operating position of the mandrel 48, it will be recognized that the lower O-ring 56 is sealingly engaged within the axial bore 60 of the housing 49 so as to cooperate with the upper O-ring 55 for isolating the lateral port 53.

It is generally recognized that the seal members used with fluid testers such as the tool 10 must be protected from damage whenever interacting valve members are moved relative to one another. Although that patent is directed to a completely different type of well tool, the problem of such seal damage is fully discussed in U.S. Pat. No. 3,363,696. As described in that patent, the damage to seals such as a typical elastomeric O-ring will usually occur under extreme pressure differentials as an unconfined O-ring is moved across a lateral port or is moved into a close-fitting bore. If the pressure differential is acting to partially lift or extrude an unconfined O-ring out of its associated groove, the exposed portion of the O-ring may be sheared off as it crosses the sharp edge of a port or enters a close-fitting bore.

Accordingly, with the fluid measuring means 45 of the new and improved tool 10, the O-ring 56 is protected from damage such as described above by means of a protective sleeve 66 which is cooperatively fitted around a lower portion of the mandrel 48 and normally biased upwardly against a downwardly facing mandrel shoulder 67 by a coil spring 68 coaxially disposed around the mandrel between the protective sleeve and another tubular body 69 slidably mounted on the lower end of the mandrel. As illustrated in FIG. 3C, the protective sleeve 66 is appropriately sized so that the lower O-ring 56 will be snugly disposed within the internal bore of the sleeve so long as the mandrel 48 is in its lower operating position. In this way, as the mandrel 48 is moved upwardly toward its upper operating position, the biasing action of the spring 68 will be effective to firmly engage the nose of the protective sleeve 66 against the lower end of the housing 54 and keep it there so as to protect the O-ring 56 as it moves out of the sleeve 66 and enters the axial bore 60 of the housing 54. Thus, regardless of the direction of the pressure differential, by always confining the O-ring 56 it is safeguarded from extrusion and possible damage when the tool 10 is working under extreme pressure differentials.

As previously mentioned, the anchoring means 46 of the testing tool 10 are selectively operable for releasably anchoring the testing tool in the tubular body 17 to carry out the testing operations of the tool and then subsequently releasing the tool for retrieval. Accordingly, as seen in FIGS. 3A and 3B, the new and improved tool anchoring means 46 include two or more outwardly-biased elongated anchor members or lugs, as at 70, that are mounted in upright positions within the tool housing 49 with their outer edges respectively projecting from elongated slots or openings, as at 71, which are uniformly disposed around the midportion of the tool housing. The exposed outer edges or forward portions of the anchor lugs 70 are each fashioned to define upper and lower projections or shoulders, as at 72 and 73, that are respectively shaped to be complementally received within the two circumferential grooves 28 and 29 within the upper end piece 18 of the valve means 14. Tangs, as at 74 and 75, are respectively provided on the upper and lower ends of the several anchor lugs 70 to limit the outward extension of the lugs in response to outward biasing forces as preferably supplied by a plurality of springs, as at 76, supported on a small-diameter tubular member 77 disposed within the tool housing 49 and coaxially mounted around the midportion of the tool mandrel 48 to engage the rearward portions of the lugs.

As illustrated in FIG. 3B, the new and improved tool anchoring means 46 also include a larger tubular member 78 that is coaxially disposed within the tool housing 49 around the smaller tubular member 77 and adapted for longitudinal movement relative thereto between the depicted initial lower position and an ultimate higher position. The lower portion of this larger tubular member 78 is provided with a plurality of longitudinally-elongated openings, as at 79, that respectively are cooperatively arranged to loosely receive the rearward portions of the several anchor lugs 70 without restricting their independent lateral movements.

For reasons that will subsequently be explained, the tool anchoring means 46 further include anchor retracting means which, in the preferred embodiment of the testing tool 10, are provided by suitably sizing and shaping the elongated openings 79 in the larger tubular member 78 so as to define downwardly and inwardly inclined camming surfaces, as at 80, which are spatially disposed a considerable distance below complemental camming surfaces 81 on the lower ends of the lower tangs 75 when the larger tubular member is in its illustrated lower position. The anchor retracting means further include means for elevating the larger tubular member 78 such as internal threads 82 within the upper end of the larger tubular member and threadably engaged with external threads 83 on the reduced-diameter lower end portion of a tubular member 84 that is coaxially disposed around the upper portion of the mandrel 48 below the longitudinal mandrel groove 65 and rotatably journalled as by upper and lower bearings 85 and 86 cooperatively mounted within an enlarged chamber 87 in the upper portion of the tool housing 49.

Figure 4:
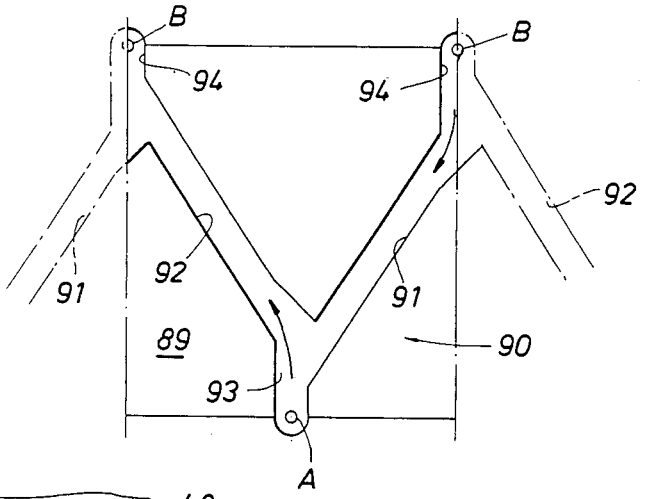
FIG. 4 is a somewhat-schematic drawing showing a particular design detail of the testing tool shown in FIGS. 3A–3C.

As depicted in FIGS. 3A and 4, the anchor retracting means further include cable-actuated indexing means such as an inwardly directed pin 88 mounted in the enlarged-diameter upper portion 89 of the rotatable tubular member 84 with its free end slidably disposed within a system 90 of interconnected outwardly facing grooves formed in the exterior surface of either an enlarged-diameter integral portion of the mandrel 48 or a sleeve sleeve secured around the mandrel just below the lower end of the longitudinal groove 65. As depicted by the developed view of the preferred system 90 of interconnected grooves shown in FIG. 4, a downwardly inclined groove 91 on one half of the mandrel 48 and an upwardly inclined groove 92 on the other half of the mandrel are joined at their adjacent lower ends by a short, upwardly opening vertical groove 93 and the adjacent upper ends of these inclined grooves are similarly joined by a short, downwardly opening vertical groove 94. It should be noted that the upwardly opening groove 93 is aligned with the upper surface of the lower end or entrance to the upwardly inclined groove 92 so that the downward travel of the mandrel 48 will always cause the upwardly inclined groove to move over the indexing pin 88. Similarly, the downwardly opening groove 94 is aligned above the lower surface of the entrance or upper end of the downwardly inclined groove 91 to ensure that the upward travel of the mandrel 48 will always cause the downwardly inclined groove to be moved over the indexing pin 88.

In this manner, since the coaction of the guide pin 64 and the longitudinal mandrel groove 65 prevents the mandrel 48 from rotating in relation to the tool housing 49, successive upward and downward movements of the mandrel in relation to the housing will correspondingly carry the interconnected indexing grooves 90 upwardly and downwardly with respect to the pin 88 and, as the pin is thereby turned by the inclined surfaces, thereby translate this reciprocating motion of the mandrel into a successive turning movement of the tubular member 84. It will, of course, be recognized that with this illustrated arrangement of the groove system 90, the tubular member 84 will be turned only one half of a revolution each time the supporting cable 12 is slacked off to lower the mandrel 48 with respect to the housing 49; and that the tubular member 84 will then be turned an additional one half of a revolution each time the supporting cable is picked up to raise the mandrel relative to the housing. Since the vertical grooves 93 and 94 are cooperatively aligned to sequentially guide the inclined grooves 91 and 92 over the pin 88, the tubular member 84 will always be turned in the same rotational direction. Rotation of the tubular member 84 will, of course, ultimately raise the tubular member 78 sufficiently to engage the inclined surfaces 80 on the tubular member 78 with the inclined surfaces 81 on the anchor lugs 70 and thereby retract the anchor lugs when the tubular member 84 reaches its ultimate elevated position. Thus, it will be recognized that by arranging the pitch and number of the coacting threads 82 and 83 to require a given number of rotations of the tubular member 84 before the anchor lugs 70 are retracted, the testing tool 10 can be readily arranged to conduct a predetermined number of testing operations before the tool is retrieved.

Turning now to FIG. 3C, it will be seen that the valve actuating means 47 of the tool 10 include two or more outwardly-biased elongated lugs, as at 95, which are respectively mounted in upright positions within the tubular body 69 coaxially mounted on the lower end of the mandrel 48. The lugs 95 are arranged with their outer edges respectively projecting from elongated openings, as at 96, uniformly disposed around the body 69. Biasing means, such as coil springs 97, are cooperatively mounted within the body 69 for normally urging the lugs 95 outwardly. Tangs, as at 98 and 99, are respectively arranged on the upper and lower ends of the lugs 95 to limit the outward extension of the lugs.

The outer edges of the lugs 95 are each shaped so as to define upper and lower shoulders, as at 100 and 101, which are separated by an outwardly-facing, rectangular recess 102. As will subsequently be explained by reference to FIGS. 5–8, the lower edges of the the lower shoulders 101 are bevelled inwardly and downwardly so that as the tool 10 is lowered into the valve means 14, these bevelled surfaces will direct the lower shoulders of the lugs 95 into the upper end of the actuator 40. As the lugs 95 enter the actuator 40, the biasing action of the springs 97 will urge the shoulders 101 outwardly into a complementally-shaped, inwardly-facing circumferential groove 103 around the upper end of the axial bore of the actuator 40 (FIG. 2). At the same time, the upper shoulders 100 of the lugs 95 will be disposed over an inwardly-directed circumferential shoulder 104 around the upper end of the actuator 40. In this manner, the opposed upper and lower faces of the rectangular recesses 102 in the lugs 95 will be effective for reciprocating the actuator 40 upwardly and downwardly as the mandrel 48 is successively raised and lowered during the operation of the tool 10. As will also be subsequently explained, the upper edges of the upper shoulders 100 of the lugs 95 are bevelled inwardly and upwardly, as at 105, so that when the tool 10 is ultimately withdrawn from the valve means 14, these bevelled upper edges will engage the downwardly facing shoulder 30 within the axial bore 24 of the valve body 17 and thereby shift the lugs 95 inwardly to disengage them from the valve actuator 40 at the conclusion of the testing operation.

PRACTICE OF THE INVENTION

Figure 5:
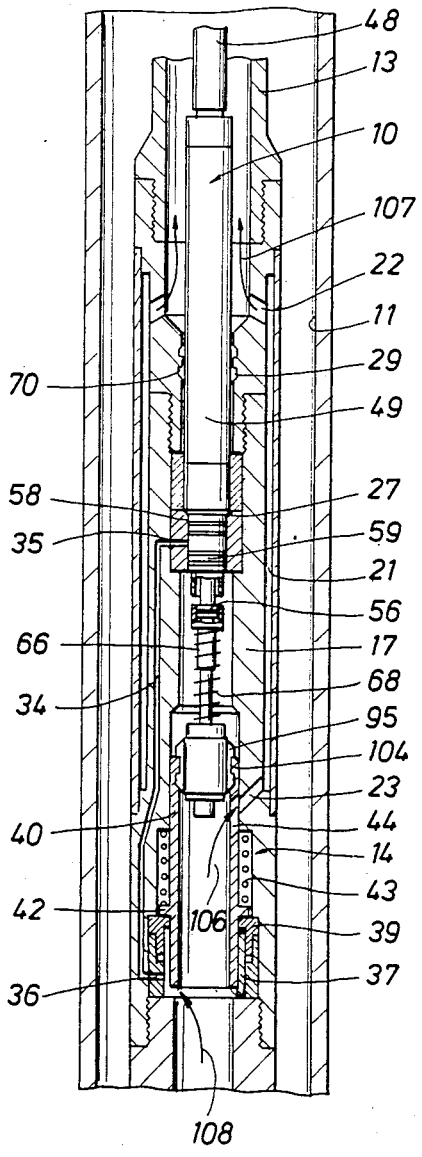
FIGS. 5–8 are somewhat-schematic views depicting the testing apparatus shown in FIGS. 2 and 3A–3C as the successive steps of the new and improved methods of the present invention are practiced by means of that apparatus.
Figure 6:
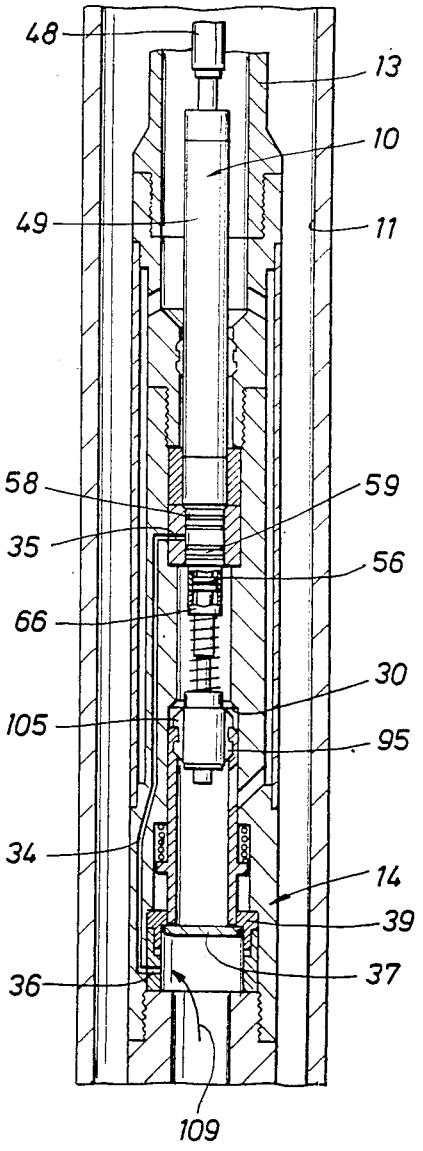

Turning now to FIGS. 5 and 6, the wireline testing tool 10 of the invention is depicted as it will successively appear while practicing the methods of the invention to make a series of measurements while connate fluids are produced from the isolated formation interval 16 and a series of measurements while the formation interval is shut-in.

As discussed by reference to FIG. 1, to employ the testing tool 10, a winch (not shown in the drawings) on which the cable 12 is spooled is utilized to lower the tool 10 into the tubing string 13 until the tool is positioned just above the valve means 14. The testing tool 10 is then lowered into the tubular body 17 to a measuring station such as defined when a shoulder 106 on the tool housing 49 is seated on the shoulder 27 within the valve body and the sealing members 58 and 59 on the housing are sealingly engaged with the valve body above and below the port 35.

It will be seen from FIG. 5 that as the tool 10 first enters the valve body 17, the lugs 95 on the lower end of the mandrel 48 will engage the upper end of the actuator 40. Then, depending upon the relative strengths of the springs 43 and 68, the mandrel 48 and actuator 40 will move downwardly until the lugs 95 momentarily retract to position the external grooves 102 over the inwardly directed shoulder 104 on the actuator. This downward movement of the mandrel 48 will also shift the actuator 40 downwardly until its external shoulder 42 engages the upper surface of the valve seat 39. At the same time, as the tool 10 is lowered into the valve body 17, the anchor lugs 70 will be momentarily retracted and then urged outwardly into their respective latching positions where the lower shoulders 73 of the lugs are securely latched in the circumferential groove 29 in the body 17.

It will be recognized that the transverse surfaces defining the opposed upper faces of the circumferential groove 28 and the shoulders 73 of the anchor lugs 70 will secure the tool 10 within the valve body 17 against upward forces imposed on the tool during the testing operations. In a like manner, the transverse surfaces defining the upper and lower surfaces of the grooves 102 engaged over the shoulder 104 on the actuator 40 will assure that the mandrel 48 will remain securely latched to the actuator during the testing operations. Once the tool mandrel 48 is latched to the valve actuator 40, the winch may be controlled as needed to move the cable 12 upwardly and downwardly for moving the mandrel and actuator along the span of travel established by the coaction of the pin 64 within the groove 65.

While the tool 10 is being lowered into the tubing string 13, the mandrel 48 will be extended with respect to the housing 49 with the bottom of the groove 65 engaging the pin 64 and the pin 88 disposed in the upwardly facing groove 93 (as at "A" in FIG. 4). From FIG. 5 it will be seen that as the tool 10 is first positioned in the valve body 17, the housing 49 will be seated on the shoulder 27 thereby permitting the mandrel 48 to be lowered further to its telescoped position. As described by reference to FIG. 4, this downward travel of the mandrel 48 will carry the inclined groove 92 downwardly relative to the pin 88 as the tubular member 84 is turned one-half of a revolution for incrementally elevating the member 78. This incremental rotation of the member 84 will be halted when the downwardly facing groove 94 is disposed over the pin 88 (as at "B").

This downward movement of the actuator 40 is effective for moving its lower end through the valve seat 39 and into engagement with the upper face of the disk member 37 and thereby swing the disk downwardly to its open position as illustrated in FIG. 5. As indicated by the flow arrows 106 and 107, upon opening of the disk 37 producible connate fluids in the isolated well bore interval 16 will flow into the tubing string 13 above the valve means 14 by way of the ports 44, the ports 23, the external passage 21 and the ports 22. At the same time, as indicated by the flow arrow 108, the flowing connate fluids will also be communicated with the enclosed chamber 50 carrying the sensor 51 by way of the port 36, the passage 34 and the port 35 in the valve body 17 and the lateral ports 57 and 53 and the longitudinal passage 52 in the testing tool 10 to obtain one or more dynamic measurements of the connate fluids.

Those skilled in the art will recognize, of course, that by arranging the external and internal fluid passages 21 and 24 of the valve body 17 to have equal cross-sectional areas, there will be only minimal disturbances to the flowing connate fluids when the tool 10 is seated in the valve body and the measurements will be substantially representative of the normal dynamic flow conditions when the tool 10 is not positioned in the valve body. It will, of course, be appreciated that the reliability of the tool anchoring means 46 allows the mandrel 48 to remain in its lower operating position as depicted in FIG. 5 as long as may be deemed necessary to obtain one or more representative dynamic measurements Whenever it is desired to obtain measurements of the static conditions of the isolated well bore 16, the winch at the surface is operated as needed for raising the suspension cable 12 sufficiently to shift the mandrel 48 from its lower operating position as depicted in FIG. 5 to its elevated position as depicted in FIG. 6. Hereagain, the reliability of the tool anchoring means 46 will allow the suspension cable 12 to be raised sufficiently to be certain that the mandrel 48 has indeed been moved upwardly without inadvertently releasing the tool 10 from the valve body 17. Those skilled in the art will realize, therefore, that the operator controlling the cable winch at the surface needs only to monitor the output signals of the typical weight indicator or strain gauge supporting the upper cable sheave (none of which are shown in the drawings) to be certain that the mandrel 48 has moved to its elevated position without applying excessive tension to the cable 12.

Accordingly, when the cable 12 has been raised to shift the mandrel 48 to its extended operating position shown in FIG. 6, the valve actuator 40 will have been raised sufficiently to allow the disk 37 to swing upwardly into seating engagement with the valve seat 39 and block fluid communication between the isolated well bore interval 16 and the pipe string 13. At the same time, the lower O-ring 56 will have been shifted upwardly into the tool housing 49 for closing the lower portion of the axial bore 60 of the housing. Although seating of the disk 37 serves to discontinue the flow of connate fluids into the pipe string 13, as indicated by the flow arrow 109 the fluids in the isolated interval 16 will still be communicated with the fluid sensor 51 by way of the port 36, the passage 34 and the port 35 in the valve body 17 and the aligned lateral ports 57 and 53 and the mandrel passage 52 in the tool 10. In this manner, shut-in measurements can be obtained by the sensor 51. Hereagain, the reliability of the tool anchoring means 46 will insure that the tool 10 will remain fixed in the valve body 17 and withstand any upwardly acting pressure forces as long as may be necessary to obtain a desired number of measurements of one or more fluid characteristics while the fluids in the isolated well bore interval 16 are under static or so-called shut-in conditions.

Figure 7:
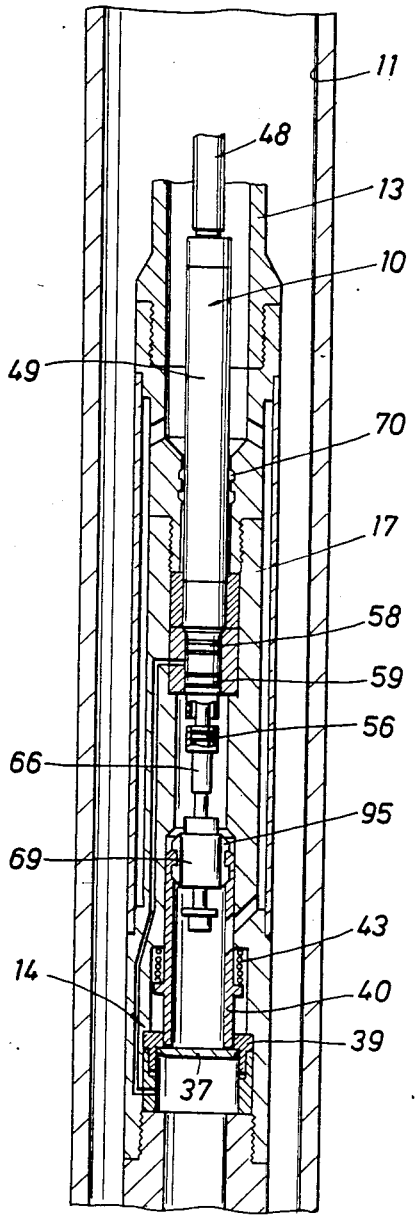

As previously mentioned, in the practice of the present invention, a plurality of static and dynamic measurements are alternately made of the connate fluids. Accordingly, following the initial shut-in measurement as just described by reference to FIG. 6, the cable winch at the surface is operated to return the mandrel 48 to its lower operating position for making another dynamic measurement. Those skilled in the art will realize, however, that there may be a substantial buildup of pressure in the isolated interval 16 when a shut-in measurement is taken so that an upward pressure force of substantial magnitude will often be imposed on the disk 37. Thus, frequently the weight of the mandrel 48 is initially ineffective for promptly opening the seated disk 37. When this occurs, as shown in FIG. 7, lowering of the mandrel 48 will again shift the lower O-ring 56 below the housing 49 even though the lost-motion connection of the member 69 on the mandrel will allow the actuator 40 to initially remain in its elevated position on top of the still-closed disk 37. In this manner, by virtue of the pressure-equalizing means provided by the fluid passage 34 and the ports 35, 36 and 57 as well as the now-open annular space 60, the pressure above the closed disk 37 will ultimately be equalized with the pressure in the isolated well bore interval 16. Once these pressures are at least substantially equalized, the weight of the mandrel 48 and the downward force of the spring 43 will finally shift the actuator 40 on through the valve seat 39 for reopening the disk 37. This will, therefore, enable a second dynamic measurement to be taken in the same manner as described above.

It will, of course, be recalled that the indexing means provided by the pin 88 and the system 90 of interconnected grooves are effective for progressively turning the rotatable tubular member 84 as the mandrel 48 is repetitively lowered and raised for making a predetermined number of dynamic and static measurements during the practice of the present invention. Thus, as the mandrel 48 is repetitively reciprocated, these successive rotational movements of the tubular member 84 will progressively elevate the tubular member 78 until its bevelled surfaces 80 engage the bevelled surfaces 81 on the anchor lugs 70. Once these bevelled surfaces 80 and 81 are engaged, the continued elevation of the tubular member 78 will retract the anchor lugs 70 sufficiently to withdraw their respective shoulders 73 from their tool-anchoring positions within the circumferential groove 29 in tool body 17.

Figure 8:
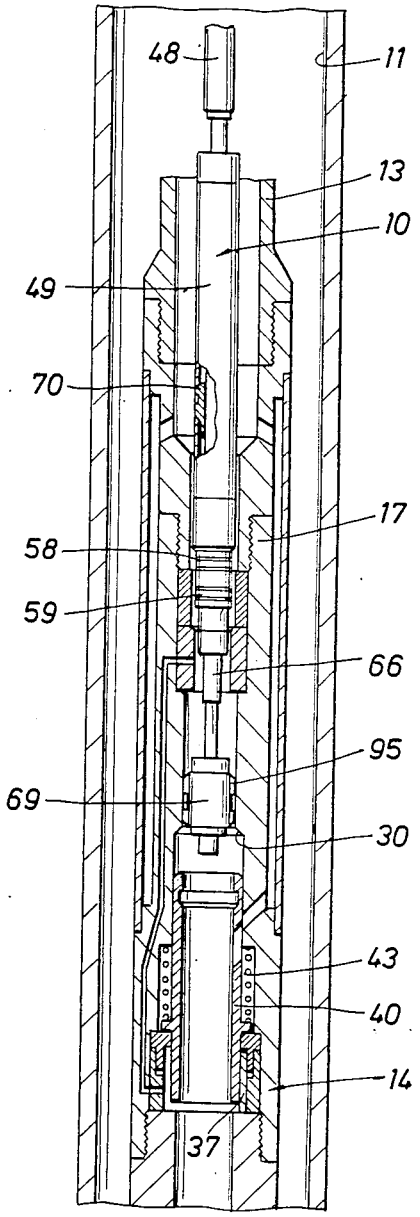

It will, of course, be recognized that once the lower shoulders 73 of the anchor lugs 70 have been disengaged from the circumferential groove 29, the next upward movement of the suspension cable 12 will then lift the tool 10 relative to the valve body 17. Thus, as seen in FIG. 8, upward movement of the cable 12 will raise the mandrel 48 to its extended position in relation to the tool housing 49. As this occurs, the extended lugs 95 will also raise the valve actuator 40 to its elevated position thereby allowing the disk 37 to swing upwardly into seating engagement with the valve seat 39. With the anchor lugs 70 now being disengaged from the valve body 17, the tool mandrel 48 can then be sufficiently elevated that the upper shoulders 105 on the lower lugs 95 will engage the downwardly facing shoulder 30 in the axial bore 24 of the tool body 17 and thereby release the lower lugs from the valve actuator 40. Recovery of the tool 10 will, of course, be readily accomplished by simply operating the winch so as to bring the tool to the surface.

Generally the disk member 37 will initially remain seated on the valve seat 39. Nevertheless, once the tool 10 is pulled upwardly sufficiently to move the sealing members 59 above the upper port 35, this upper port will be communicated by way of the body passage 34 to the lower port 36 below the disk valve 37 to equalize any pressure differential tending to keep the disk valve closed. Thus, whenever this pressure differential is at least substantially reduced, the force of the spring 43 will be capable of again shifting the actuator 40 downwardly through the valve seat 39 for reopening the valve disk.

Accordingly, it will be appreciated that the present invention has provided new and improved methods and apparatus for performing static and dynamic test of the connate fluids in an isolated interval of a production well. By cooperatively arranging the testing apparatus to be securely anchored in the production string of the well being tested, multiple measurements can be successively made of one or more characteristics of the connate fluids while the well is under both dynamic and static conditions. Moreover, in the practice of the invention, since the new and improved testing tool of the present invention is cooperatively arranged to remain securely anchored in its chosen measuring station, successive measurements may be taken over any time period that may be deemed necessary to achieve a desired testing result.

While only a particular embodiment of the present invention and one mode of practicing the invention have been shown and described, it is apparent that various changes and modifications may be made without departing from this invention in its broader aspects; and, therefore, the aim in the appended claims is to cover all such changes and modifications as fall within the true spirit and scope of this invention.

What is claimed is:

1. A method for testing a production well having a production string therein including a packer isolating a lower well bore interval, a pipe string coupled to said packer and extending to the surface, means including a valve having an actuator operable in response to its upward and downward movement for controlling the flow of connate fluids from said isolated well bore interval into said pipe string, and means defining a measuring station above said valve having passage means in communication with said isolated well bore interval, and comprising the steps of:

connecting a suspension cable to a testing tool carrying fluid-measuring means adapted to measure a characteristic of connate fluids and including anchoring means adapted to be engaged with said measuring station and subsequently released therefrom only after a predeterminded number of successive upward and downward movements of said suspension cable so that a corresponding number of said multiple measurements can be obtained before said anchoring means are released, and coupling means adapted to be releasably coupled to said actuator when said anchoring means are engaged with said measuring station;

lowering said testing tool into said production string until said anchoring means are engaged with said measuring station for communicating said fluid-measuring means with said passage means and coupling said coupling means to said actuator; and successively moving said suspension cable upwardly and downwardly for repetitively opening and closing said valve to obtain multiple measurements of said fluid characteristic before said anchoring means are released from said measuring station.

2. The method of claim 1 wherein said fluid characteristic is the pressure of the connate fluids.

3. The method of claim 1 further including the step of recording said multiple measurements as a function of time for providing a record of the changes in said fluid characteristic as said valve is successively opened and closed.

4. The method of claim 1 wherein said fluid characteristic is the pressure of the connate fluids and further including the step of recording said multiple measurements as a function of time for providing a record of the fluid pressure in said isolated well bore interval as said valve is successively opened and closed.

5. A method for making dynamic and static tests of a production well having a production string therein including a packer isolating a lower well bore interval, a pipe string coupled to said packer and extending to the surface, means defining a measuring station having first passage means in communication with said isolated well bore interval, and means for controlling the flow of connate fluids from said isolated well bore interval including second passage means between said isolated well bore interval and said pipe string and a valve below said measuring station having an actuator operable in response to reciprocation thereof for opening and closing said second passage means, and comprising the steps of:

connecting a suspension cable to a testing tool carrying fluid-measuring means adapted to measure a characteristic of connate fluids and including anchoring means adapted to be engaged with said measuring station and subsequently disengaged therefrom only in response to a selected number of successive reciprocations of said suspension cable, and coupling means adapted to be releasably engaged with said actuator when said anchoring means are engaged with said measuring station for reciprocating said actuator in response to successive reciprocations of said suspension cable;

lowering said testing tool into said production string until said anchoring means are engaged with said measuring station for communicating said fluid-measuring means with said first passage means and engaging said coupling means with said valve actuator; and successively reciprocating said suspension cable for said selected number of reciprocations for repetitively opening and closing said valve before said anchoring means are disengaged from said measuring station to obtain a series of dynamic measurements of said fluid characteristic whenever said valve is opened to admit connate fluids into said second passage means and a series of static measurements whenever said valve is closed.

6. The method of claim 5 wherein said fluid characteristic is the pressure of the connate fluids.

7. The method of claim 5 further including the step of recording said dynamic and static measurements as a function of time for providing a record of the changes in said fluid characteristic as said valve is successively opened and closed.

8. The method of claim 5 wherein said fluid characteristic is fluid pressure and further including the step of recording said dynamic and static measurements as a function of time for providing a record of the fluid pressure in said isolated well bore interval as said valve is successively opened and closed.

9. A method for making dynamic and static pressure tests of a production well having a production string therein including a packer isolating a lower well bore interval, a pipe string coupled to said packer and extending to the surface, means defining a measuring station having first passage means in communication with said isolated well bore interval, and means for controlling the flow of connate fluids from said isolated well bore interval including second passage means between said isolated well bore interval and said pipe string and a full-opening valve below said measuring station having an actuator operable in response to reciprocation thereof for opening and closing said second passage means, and comprising the steps of:

connecting a suspension cable to a testing tool carrying a pressure sensor and including anchoring means adapted to be engaged with said measuring station and subsequently disengaged therefrom only in response to a selected number of successive reciprocations of said suspension cable, pressure-equalizing means responsive to reciprocation of said suspension cable for equalizing pressures on opposite sides of said full-opening valve whenever said suspension cable is moved for opening said full-opening valve, and coupling means adapted to be releasably engaged with said actuator when said anchoring means are engaged with said measuring station for reciprocating said actuator as said suspension cable is successively reciprocated;

lowering said testing tool into said production string until said anchoring means are engaged with said measuring station for communicating said pressure sensor with said first passage means and engaging said coupling means with said valve actuator;

moving said suspension cable in one direction for closing said full-opening valve to obtain a first static pressure measurement when said valve is closed;

moving said suspension cable in the opposite direction for opening said full-opening valve whenever said pressure-equalizing means equalize the pressures impeding reopening of said full-opening valve; and successively reciprocating said suspension cable until said anchoring means are disengaged from said measuring station for repetitively opening and closing said full-opening valve to obtain a series of successive dynamic pressure measurements whenever said full-opening valve is opened to admit connate fluids into said second passage means and a series of successive static pressure measurements whenever said full-opening valve is closed.

10. Apparatus adapted for testing a production well having a production string therein including a packer isolating a lower well bore interval and a pipe string coupled to said packer and extending to the surface and comprising:

valve means adapted to be cooperatively arranged in said production string and having an actuator operable by upward and downward movement thereof for controlling the flow of connate fluids from said isolated well bore interval;

means providing a measuring station including a tubular body adapted to be cooperatively arranged in said production string above said valve means and including means for supporting a testing tool at an intermediate location therein, first passage means adapted for communicating said production string below said valve means with a measuring port opening into said body at said intermediate location, and second passage means adapted for communicating said production string above said valve means with said production string above said measuring port;

a testing tool adapted for suspension in said production string including fluid-measuring means adapted for being communicated with said measuring port, and inner and outer members telescoped together with said inner member being movable between spaced upper and lower positions within said outer member in response to upward and downward movements of a suspension cable coupled to said inner member;

tool-anchoring means cooperatively arranged on said testing tool and including at least one anchor member movable between an extended position for anchoring said testing tool in said measuring station and a retracted position where said testing tool is released for movement therefrom, and anchor-retracting means responsive to successive upward and downward movements of said inner member for retracting said anchor member; and valve-actuating means cooperatively arranged on said inner member and adapted for releasably engaging said actuator while said testing tool is in said measuring station for selectively closing and opening said valve means in response to said upward and downward movements of said inner member.

11. The apparatus of claim 10 wherein said fluid-measuring means include a pressure sensor for measuring the pressure of connate fluids in said first passage means.

12. The apparatus of claim 10 further including pressure-equalizing means cooperatively arranged between said inner and outer members for communicating said first passage means with said production string above said valve means upon downward movement of said inner member for opening said valve means.

13. The apparatus of claim 12 further including means providing a lost-motion connection between said valve-actuating means and said actuator for delaying opening of said valve means until the fluid pressures above and below said valve means have been at least substantially equalized.

14. The apparatus of claim 10 further including an internal recess in said tubular body adapted to receive said anchor member upon movement thereof to its said extended position for securely anchoring said testing tool in said measuring station.

15. The apparatus of claim 10 wherein said anchor-retracting means include an intermediate member cooperatively arranged between said inner and outer members and adapted to be moved into engagement with said anchor member, and camming means on said intermediate member and said anchor member cooperatively arranged for retracting said anchor member from its said extended position as said intermediate member is moved still further toward said anchor member.

16. Apparatus adapted for testing a production well having a production string therein including a packer isolating a lower well bore interval and a pipe string coupled to said packer and extended to the surface and comprising:

full-bore valve means including a tubular body adapted to be cooperatively arranged in said production string, means defining an annular valve seat within said valve body, a disk valve member pivotally mounted within said valve body and adapted to swing therein between a depending passage-opening position along one wall of said valve body and a passage-closing position seated on said valve seat, biasing means normally urging said disk valve member toward its said passage-closing position, and a tubular actuator movably mounted within said valve body for longitudinal movement between an upper position where the lower end of said valve actuator is above said valve seat and a lower position where the lower end of said valve actuator has passed through said annular valve seat for urging said disk valve toward its said passage-opening position, and biasing means normally urging said actuator member toward its said lower position;

means providing a measuring station including a tubular body adapted to be cooperatively arranged in said production string above said full-bore valve means and including means for supporting a testing tool at an intermediate location in said tubular body, first passage means adapted for communicating said production string below said valve seat with a measuring port opening into said tubular body at said intermediate location, and second passage means adapted for communicating said production string above said valve means with said production string above said measuring port;

a testing tool including inner and outer members telescopically arranged together for longitudinal movement of said inner member between upper and lower positions within said outer member in response to upward and downward movements of a suspension cable coupled to and supporting said inner member;

fluid-measuring means on one of said inner and outer members cooperatively arranged to be in communication with said measuring port when said testing tool is in said measuring station; valve-actuating means cooperatively arranged on the lower end of said inner member and adapted for releasably engaging the upper end of said valve actuator while said testing tool is in said measuring station for selectively closing and opening said valve means in response to said upward and downward movements of said inner member; and tool-anchoring means including a plurality of laterally-movable anchor members cooperatively arranged on said outer member for movement between extended and retracted positions, means defining a complemental recesss in said tubular body adapted to receive said anchor members respectively upon movement thereof to their said extended positions for securely anchoring said testing tool in said measuring station, and anchor-retracting means between said inner and outer members and cooperatively arranged for retracting said anchor members only after said inner member has been moved upwardly and downwardly for a predetermined number of successive movements.

17. The apparatus of claim 16 wherein said anchor-retracting means include a first intermediate member rotatably mounted within said outer member and disposed around said inner member, a second intermediate member slidably mounted around said inner member and adapted for longitudinal movement within said outer member between spaced upper and lower positions, means defining coengaged threads on said first and second intermediate members cooperatively arranged to move said second intermediate member between its said spaced positions upon rotation of said first intermediate member, indexing means cooperatively arranged between said inner member and said first intermediate member for progressively rotating said first intermediate member as said inner member is successively moved upwardly and downwardly, and camming means on said second intermediate member and said anchor members respectively arranged for retracting said anchor members from their said extended positions as said second intermediate member is moved into engagement with said anchor members.

* * * * *